US011867196B2

(12) United States Patent
Yu et al.

(10) Patent No.: US 11,867,196 B2
(45) Date of Patent: Jan. 9, 2024

(54) CENTRIFUGAL COMPRESSOR AND METHOD OF OPERATING THE SAME

(71) Applicant: Carrier Corporation, Palm Beach Gardens, FL (US)

(72) Inventors: Lei Yu, Shanghai (CN); Vishnu M. Sishtla, Manlius, NY (US); Sheng Chen, Shanghai (CN)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 17/960,898

(22) Filed: Oct. 6, 2022

(65) Prior Publication Data

US 2023/0024289 A1 Jan. 26, 2023

Related U.S. Application Data

(62) Division of application No. 17/106,361, filed on Nov. 30, 2020, now Pat. No. 11,493,057.

(30) Foreign Application Priority Data

Dec. 2, 2019 (CN) ..... 201911212620.0

(51) Int. Cl.
*F04D 27/02* (2006.01)
*F04D 29/46* (2006.01)
(Continued)

(52) U.S. Cl.
CPC ..... *F04D 29/462* (2013.01); *F04D 17/10* (2013.01); *F04D 27/0246* (2013.01);
(Continued)

(58) Field of Classification Search
CPC ..... F04D 27/0215; F04D 27/0207; F04D 27/023; F04D 27/0238; F04D 27/02; F04D 27/0246; F04D 29/464; F04D 29/685
See application file for complete search history.

(56) References Cited

U.S. PATENT DOCUMENTS 5,490,760 A * 2/1996 Kotzur ..... F25J 3/04109 415/115
6,929,035 B2 8/2005 Debaisieux et al.
(Continued)

FOREIGN PATENT DOCUMENTS

CN 101636594 A 1/2010
CN 1745253 B 6/2010
(Continued)

OTHER PUBLICATIONS

DE-3605958—Translation from Espacenet (Year: 1986).*
European Search Report for Application No. 20211321.3; dated Apr. 26, 2021; 5 Pages.

*Primary Examiner* — Justin D Seabe
*Assistant Examiner* — Behnoush Haghighian
(74) *Attorney, Agent, or Firm* — CANTOR COLBURN LLP

(57) ABSTRACT

A centrifugal compressor and a method of operating a centrifugal compressor. The centrifugal compressor includes: an impeller configured to suction a gas to be compressed; a diffuser disposed downstream of the impeller to pressurize the gas, the diffuser comprising a movable ring, a main passage in which the gas flows past the ring, and an openable branch passage; and a circulation loop comprising an inlet and an outlet, the outlet being in communication with an inlet of the impeller; the branch passage is disposed to be in communication with the main passage and the circulation loop when the ring moves into the main passage
(Continued)

so that a portion of the gas in the main passage passes through the circulation loop and returns to the impeller so as to be suctioned, and to be closed when the ring is withdrawn from the main passage.

3 Claims, 8 Drawing Sheets

(51) Int. Cl.
*F04D 17/10* (2006.01)
*F04D 29/42* (2006.01)

(52) U.S. Cl.
CPC ..... *F04D 27/023* (2013.01); *F04D 27/0207* (2013.01); *F04D 27/0215* (2013.01); *F04D 29/4213* (2013.01)

(56) References Cited

U.S. PATENT DOCUMENTS

| | | | | |
|---|---|---|---|---|
| 6,945,748 | B2 | 9/2005 | Svihla et al. | |
| 7,210,295 | B2 * | 5/2007 | McEwen | F04D 25/04 415/164 |
| 8,061,323 | B2 | 11/2011 | Konzelmann et al. | |
| 8,061,974 | B2 | 11/2011 | Gu et al. | |
| 8,122,724 | B2 | 2/2012 | Slovisky et al. | |
| 8,287,233 | B2 * | 10/2012 | Chen | F04D 29/4213 415/206 |
| 9,086,067 | B2 * | 7/2015 | Masuda | F04C 29/122 |
| 9,790,953 | B2 * | 10/2017 | Kleynhans | F04D 29/162 |
| 10,302,104 | B2 | 5/2019 | Schmidt et al. | |
| 2007/0224032 | A1 | 9/2007 | Gu et al. | |
| 2011/0283977 | A1 | 11/2011 | Iwata et al. | |
| 2013/0216418 | A1 * | 8/2013 | Masuda | F04C 29/068 418/191 |
| 2015/0285134 | A1 | 10/2015 | Palko | |
| 2018/0340549 | A1 | 11/2018 | Hall et al. | |
| 2021/0164493 | A1 | 6/2021 | Yu et al. | |

FOREIGN PATENT DOCUMENTS

| | | | | |
|---|---|---|---|---|
| CN | 101065582 | B | 9/2010 | |
| CN | 1867776 | B | 10/2010 | |
| CN | 101027491 | B | 12/2010 | |
| CN | 102213253 | A | 10/2011 | |
| CN | 202266789 | U | 6/2012 | |
| CN | 101560987 | B | 7/2013 | |
| CN | 101842599 | B | 1/2014 | |
| CN | 103270272 | B | 9/2014 | |
| CN | 104321513 | A | 1/2015 | |
| CN | 204200674 | U | 3/2015 | |
| CN | 102007301 | B | 7/2015 | |
| CN | 103201462 | B | 8/2015 | |
| CN | 103174678 | B | 9/2015 | |
| CN | 102834622 | B | 2/2016 | |
| CN | 104019058 | B | 3/2016 | |
| CN | 205425339 | U | 8/2016 | |
| CN | 106440182 | A | 2/2017 | |
| CN | 105051372 | B | 5/2017 | |
| CN | 104781519 | B | 6/2017 | |
| CN | 106838521 | A | 6/2017 | |
| CN | 107084638 | A | 8/2017 | |
| CN | 104854351 | B | 9/2017 | |
| CN | 105026769 | B | 8/2018 | |
| CN | 108713100 | A | 10/2018 | |
| CN | 108895214 | A | 11/2018 | |
| CN | 109163159 | A | 1/2019 | |
| CN | 110131213 | A | 8/2019 | |
| CN | 110418899 | A | 11/2019 | |
| DE | 3605958 | A1 * | 2/1986 | F04D 27/001 |
| DE | 3605958 | A1 | 9/1987 | |
| DE | 102015203551 | A1 | 9/2016 | |
| DE | 102018119730 | A1 | 2/2020 | |
| EP | 0811768 | B1 | 12/1997 | |
| EP | 1788259 | A1 | 5/2007 | |
| EP | 1753960 | B1 | 6/2008 | |
| EP | 2025896 | B1 | 5/2011 | |
| EP | 2129921 | B1 | 12/2011 | |
| GB | 2527377 | A | 12/2015 | |
| JP | S55142994 | A | 11/1980 | |

* cited by examiner

CENTRIFUGAL COMPRESSOR AND METHOD OF OPERATING THE SAME

FOREIGN PRIORITY

This application is a divisional of U.S. patent application Ser. No. 17/106,361, filed Nov. 30, 2020, the entire contents of which are incorporated herein by reference, which claims priority to Chinese Patent Application No. 201911212620.0, filed Dec. 2, 2019, and all the benefits accruing therefrom under 35 U.S.C. §119, the contents of which in its entirety are herein incorporated by reference.

TECHNICAL FIELD OF INVENTION

The present application belongs to the field of compressors, and in particular relates to a centrifugal compressor and a method of operating a centrifugal compressor.

BACKGROUND OF THE INVENTION

Compressors are widely used in the industrial field. A good compressor is capable of providing excellent gas compression performance. In the field of refrigeration, the compressor is a particularly critical part of a refrigeration system. As a type of compressors, centrifugal compressors are widely used in the field of commercial refrigeration due to their ability to provide efficient and large-capacity gas compression. Centrifugal compressors utilize an impeller that rotates about an axis to draw gas into the compressor and compress the gas to an outlet. The gas is directed radially outward from the axis to a collector region through a diffusion passage that increases a pressure of the gas.

A compressor characteristic map is a well-known way of plotting compressor operating conditions, wherein the Y-axis represents a pressure ratio, and the X-axis represents a mass of the flow through the compressor. A left-hand boundary of the compressor map represents a surge boundary, and operations on the left side of the boundary represent a region where the flow is unstable. Operations in this region are not desired since they may allow the pressurized gas to flow back in the compressor.

A variable diffuser technology is used to reduce noise near surge conditions. The surge boundary may or may not be improved, depending on whether the surge is triggered by the diffuser.

SUMMARY OF THE INVENTION

One aspect of the present application is to provide a centrifugal compressor capable of circulating a gas in a diffuser.

The centrifugal compressor provided by the present application comprises: an impeller configured to suction a gas to be compressed; a diffuser disposed downstream of the impeller to pressurize the gas, the diffuser comprising a movable ring, a main passage in which the gas flows past the ring, and an openable branch passage; and a circulation loop comprising an inlet and an outlet, the outlet being in communication with an inlet of the impeller; wherein the branch passage is disposed to be in communication with the main passage and the circulation loop when the ring moves into the main passage so that a portion of the gas in the main passage passes through the circulation loop and returns to the impeller so as to be suctioned, and to be closed when the ring is withdrawn from the main passage.

In addition to one or more of the features described above, or as an alternative, further embodiment may include, the main passage is defined by partitions that are opposite to each other, wherein one of the partitions is provided with a groove so that the ring fits into the groove; the branch passage is disposed between at least one surface of the ring and a wall of the groove, or inside the groove, or inside the ring, or disposed in a combination of two or three of the above manners.

In addition to one or more of the features described above, or as an alternative, further embodiment may include, at least one surface of the ring is a rear surface of the ring that faces away from the main passage and/or a side surface of the ring.

In addition to one or more of the features described above, or as an alternative, further embodiment may include, the ring has a protruding portion which protrudes into one of the partitions, and the branch passage is formed as an additional flow passage passing between front and rear surfaces of the protruding portion.

In addition to one or more of the features described above, or as an alternative, further embodiment may include, the circulation loop is integrated within the one of the partitions and located adjacent to a drive mechanism, wherein the ring is driven by the drive mechanism.

In addition to one or more of the features described above, or as an alternative, further embodiment may include, the circulation loop comprises at least one flow passage that directs the gas, the at least one flow passage is formed by machining a hole in one of the partitions, and at least one wall of the groove is in communication with the at least one flow passage.

In addition to one or more of the features described above, or as an alternative, further embodiment may include, the side surface of the ring is configured to include at least one section, and different sections have different surface shapes.

In addition to one or more of the features described above, or as an alternative, further embodiment may include, at least a portion of the circulation loop is formed by a chamber within the centrifugal compressor that is close to the impeller, and the outlet of the circulation loop is an outlet of the chamber.

In addition to one or more of the features described above, or as an alternative, further embodiment may include, the chamber is an ejection chamber of an economizer.

In addition to one or more of the features described above, or as an alternative, further embodiment may include, the ring has at least one protruding head configured to have a shape that increases gradually toward the main passage such that the head controls a flow of the gas flowing toward the circulation loop when the branch passage is open.

Another aspect of the present application is to provide a method of operating a centrifugal compressor as aforementioned. The method comprises:

moving the ring into the main passage when the centrifugal compressor is operated to approach a surge state, such that the branch passage is open between the main passage and the circulation loop, thereby a portion of the gas from the main passage passes through the circulation loop and returns to the impeller so as to be suctioned.

The present application is capable of circulating the gas flowing through the diffuser, and can actively control this circulating operation; that is, when the circulation is required, the ring moves into the main passage, the branch passage is open, and the gas can return to the impeller through the circulation loop; and when the circulation is not required, the ring is withdrawn or does not act, and the branch passage is closed.

The ring of the present application, as a component of the diffuser, can both change the flow of gas in the main passage, reducing compressor noise and vibration, and circulate a portion of the gas by opening the branch passage, improving compressor surge.

The movement of the ring of the present application is achieved by a drive mechanism. It is therefore not necessary to provide an additional controller in the compressor to control the movement of the ring. Moreover, unlike a passive control that requires setting of conditions, the present application is not limited to those conditions, and a movement timing, a moving speed, a moving duration, a moving distance and the like of the ring can be controlled by instructing the drive mechanism.

The branch passage of the present application is openable, and a closed state and an open state of the branch passage are realized by the movement of the ring. The branch passage can be formed by means of the ring and a groove in one partition in which the ring is provided. This eliminates the need for additional passages in the compressor.

The circulation loop of the present application is integrated within one partition or at least partially makes use of an existing chamber inside the compressor, so the gas circulation of the present application is an internal circulation. As compared to an external circulation or an additional circulation loop inside or outside the compressor, the cost of such a circulation is saved and the complexity of the compressor system is not increased in the present application.

A certain shape of the ring can be obtained by machining a part of the surface of the ring, and the ring of the shape is capable of controlling the circulating flow.

The present application is capable of establishing a gas circulation against stall or surge. Insufficient air intake in the impeller may cause surge. The present application can circulate a portion of the gas in the diffuser back to the impeller to supplement the amount of air intake in the impeller, thereby improving the surge boundary curve in the compressor characteristic map for plotting the operating conditions of the compressor, and improving the compressor efficiency.

Other aspects and features of the present disclosure will become apparent from the following detailed description with reference to the drawings. However, it should be understood that the drawings are intended for the purpose of illustration only, rather than defining the scope of the present disclosure, which should be determined with reference to the appended claims. It should also be understood that the drawings are merely intended to conceptually illustrate the structure and flowchart described herein, and it is not necessary to draw the figures to the scale, unless otherwise specified.

BRIEF DESCRIPTION OF THE DRAWINGS

The present application will be more fully understood from the following detailed description of specific embodiments with reference to the drawings, in which identical features are denoted by identical reference signs in different drawing, wherein.

DETAILED DESCRIPTION OF THE INVENTION

To help those skilled in the art precisely understand the subject matter of the present application, specific embodiments of the present application are described in detail below with reference to the accompanying drawings.

Figure 1:
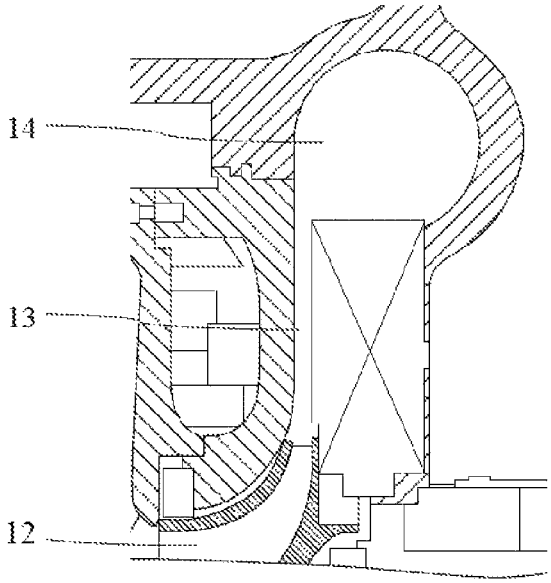
FIG. 1 is a simplified schematic view of a centrifugal compressor according to the present application.

A centrifugal compressor according to the present application may be applied to a wide range of industrial fields, and the object to be compressed may be a gas such as air or nitrogen, or a gaseous refrigerant used in a refrigerant compressor for example. In the application of the refrigeration compressor, ideally, entry of liquid refrigerant and/or lubricating oil into the refrigeration compressor is unwanted, but in actual cases, a situation in which the compressor suctions gas and carries liquid still occurs, and thus the "gas" mentioned in the present disclosure will carry a small amount of liquid under actual conditions. Referring to FIG. 1, the compressor comprises an impeller 12 configured to draw an object to be compressed, such as the aforementioned refrigerant. A diffuser 13 is located between the impeller 12 and a volute 14. The volute 14 is arranged on a radially outer side with respect to the impeller 12, and is a region for collecting the compressed and diffused refrigerant gas. After the compressed gas leaves the impeller 12, it passes through the diffuser 13 first and then enters the volute 14. In the diffuser 13, the compressed gas is pressurized after a conversion from kinetic energy into pressure energy, and is further pressurized in the volute 14.

Figure 2:
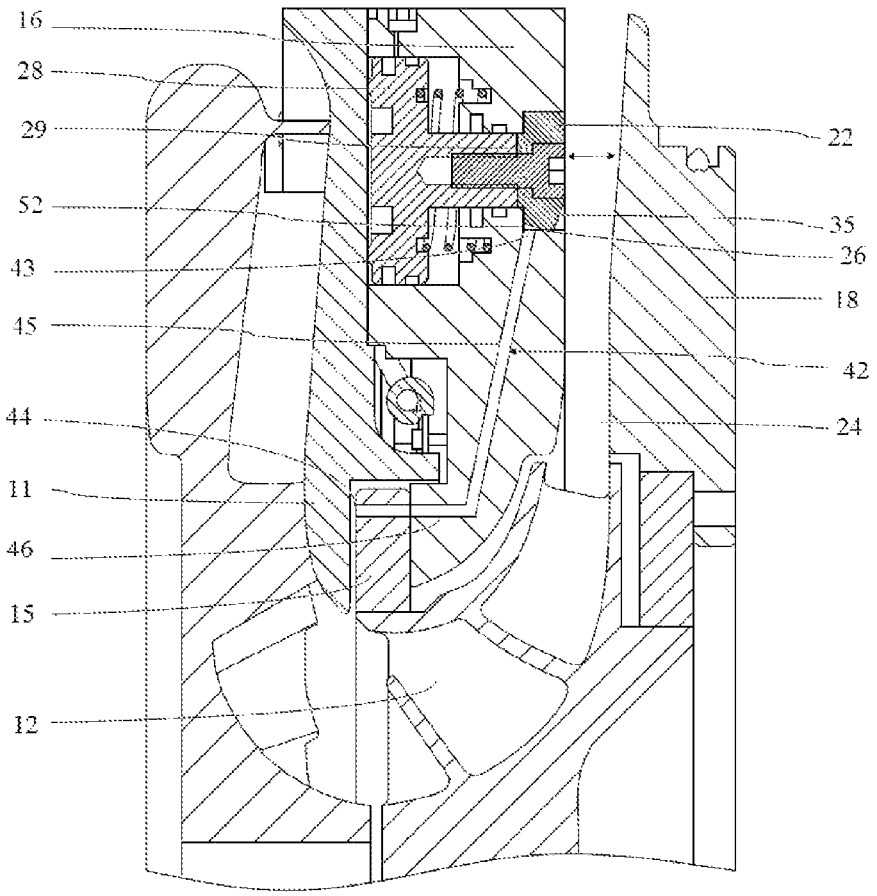
FIG. 2 is a partial sectional view of an embodiment of a centrifugal compressor according to the present application, wherein arrows indicate a ring moving direction.
Figure 3:
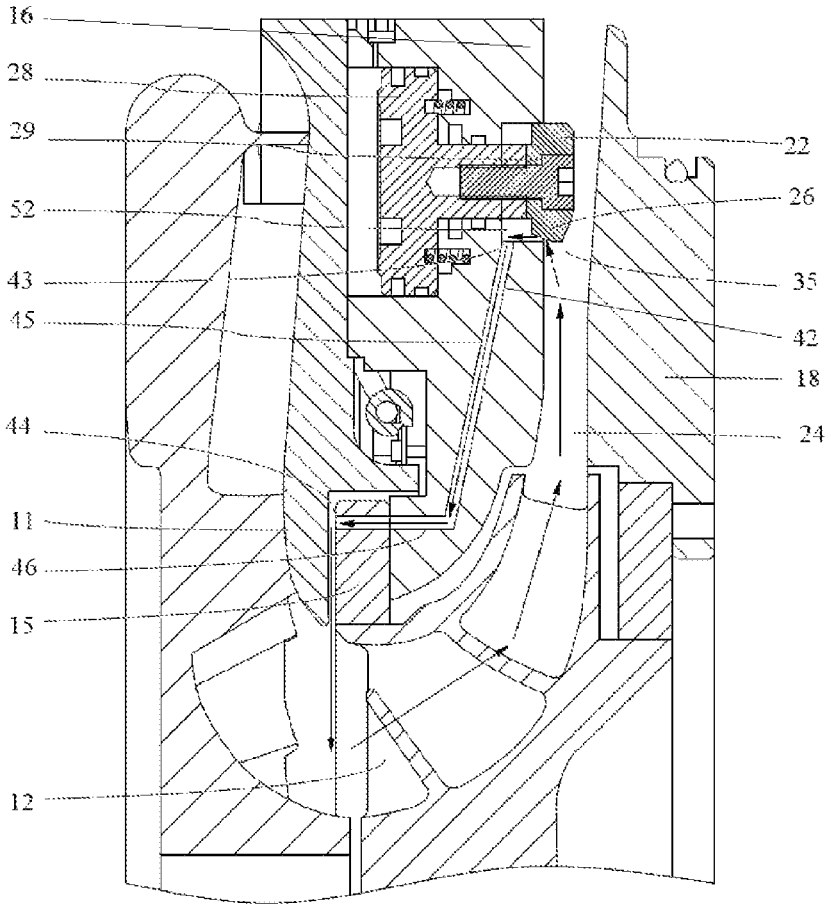
FIG. 3 is a schematic view of the centrifugal compressor of FIG. 2 when the ring moves into the main passage, wherein arrows indicate a gas circulation path.
Figure 4:
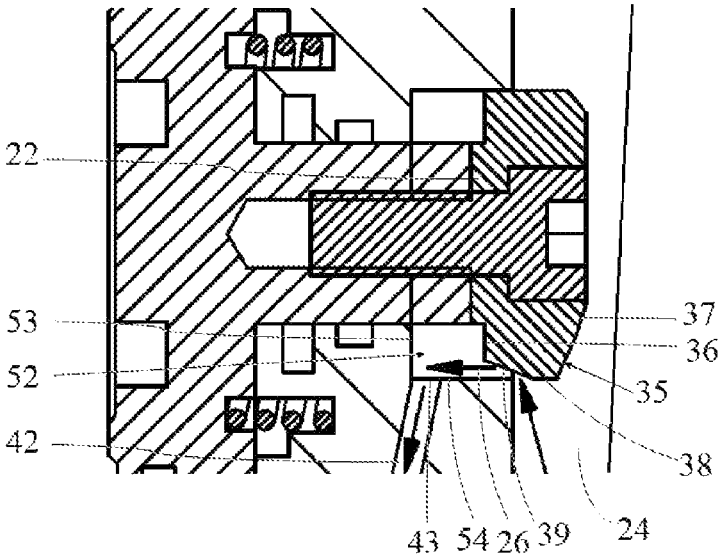
FIG. 4 is a partial enlarged view of FIG. 3.

FIGS. 2-4 show partial sectional views of an embodiment of a centrifugal compressor according to the present application. The refrigerant still serves as the object to be compressed. The diffuser comprises a first partition 16, a ring 22, a second partition 18, a main passage 24, a branch passage 26 (see FIG. 3), and a drive mechanism 28. In the illustrated embodiment, the first partition 16 and the second partition 18 face each other. The main passage 24, through which the refrigerant gas passes, is defined between the first partition 16 and the second partition 18. The width of the main passage 24 gradually increases in a radial direction so as to pressurize the refrigerant gas. It should be appreciated that the main passage 24 may be an annular chamber. Herein, the term "partition" refers to a component that divides the space within the compressor into subspaces, and the partition may also be configured to house components inside the compressor, such as the ring which will be described below. The refrigerant gas from the impeller flows towards the volute (not shown) through the main passage 24. The ring 22 is disposed on any one of the partitions, such as on the first partition 16, and is movable relative to the first partition 16. The refrigerant gas may pass past the front of the ring 22.

The ring 22 is connected to the drive mechanism 28. The drive mechanism 28 may comprise at least one actuator-piston system. The actuator may be hydraulically driven, pneumatically driven, electrically driven, or the like. A piston head 29 is embedded in the ring 22 to move together with the ring 22. The actuator-piston system may be implemented in a manner known in the art, which will not be further described herein. The ring 22 can move in the direction shown in FIG. 2 under the action of the actuator. When the ring 22 moves into the main passage 24, the width of the main passage 24 changes, thereby changing the flow and the flow rate of the refrigerant gas passing through. Although only one drive mechanism is shown, it may be contemplated that a plurality of drive mechanisms 28 may be arranged on the ring 22 to drive the ring 22 to move, such as, but not limited to, three drive mechanisms arranged on the ring at an angular interval of 120°.

FIG. 2 shows that the ring 22 in an initial position, and FIG. 3 shows that the ring 22 moves into the main passage 24. The branch passage 26 extends out of the main passage 24 to receive a portion of the refrigerant gas in the main passage 24. The branch passage 26 is formed by a gap between a side surface 35 of the ring 22 and a surface of the first partition 16, and the refrigerant gas may pass through the gap. A circulation loop 42 is connected downstream of the branch passage 26. The circulation loop 42 comprises an inlet 43 and an outlet 44, wherein the outlet 44 communicates to the inlet of the impeller 12. Therefore, when the ring 22 moves into the main passage 24, the branch passage 26 is in an open state, a portion of the refrigerant gas of the main passage 24 can flow into the circulation loop 42 via the branch passage 26, and is eventually discharged to the inlet of the impeller 12 along the circulation loop 42 so as to be suctioned by the impeller 12 again. Details of the circulation loop 42 will be explained below. The branch passage 26 connects the main passage 24 with the inlet 43 of the circulation loop 42. When the branch passage 26 is open, the branch passage 26 is open between the main passage 24 and the circulation loop 42, and the circulation loop 42 is capable of circulating a portion of the refrigerant gas flowing through the main passage 24 back to the impeller 12 to supplement a suction amount of the impeller 12. When the ring 22 is in the initial position, the branch passage 26 is closed and the circulation loop 42 does not work.

The opening and closing of the branch passage 26 are achieved by moving the ring 22, and the movement of the ring 22 is achieved by the aforementioned drive mechanism 28. In the closed state, the ring 22 retains in a groove 52 of the first partition 16 within which the ring 22 fits, and there is no gap between the side face of the ring 22 and the wall of the groove 52, so the inlet 43 of the circulation loop 42 is blocked since the branch passage 26 is closed. Under the action of the drive mechanism 28, the ring 22 moves toward the front main passage 24, a gap occurs between the side face of the ring 22 and the wall of the groove 52, and the branch passage 26 is thus open. After the ring 22 moves out of the initial position, the gap between the side surface 35 of the ring 22 and an inner wall 54 of the groove 52 can divert the refrigerant gas flowing in the main passage 24. A portion of the gas that has been diverted flows into the groove 52 through the gap, further flows into the circulation loop 42 and thereby flows back to the impeller 12.

Once the ring 22 begins to move, an axial and/or radial gap will occur between the ring 22 and the groove 52, and the side surface 35 of the ring 22 and/or a rear surface 36 of the ring 22, or a portion of the groove 52 may form the branch passage 26. It is therefore not difficult to understand that the branch passage 26 is non-permanent, and such a gap may be eliminated when the ring 22 is back to the initial position. Therefore, it is possible to control the action of the ring 22 to determine whether a part of the refrigerant gas in the main passage 24 is circulated, and it is not necessary to provide a valve or an additional controller in the branch passage 26 or in the circulation loop 42. Further, a plurality of circulation parameters such as the moment that the circulation starts, a circulation duration, and a flow can also be determined by controlling the movement of the ring 22. For example, as shown in FIG. 4, the side surface 35 of the ring 22 may be designed such that the shape of the side surface 35 conforms to expected circulation parameters. In the embodiment illustrated in FIG. 4, the side surface 35 of the ring 22 comprises a first section 37, a second section 38, and a third section 39. The first section 37 is proximate to a front surface of the ring 22, and has an inclination (or a great curvature) to reduce the resistance experienced by the ring 22 during movement; the second section 38 is a flat surface and is in contact with the inner wall 54 of the groove 52 when the ring 22 is back to the initial position, so as to close the groove 52; the third section 39 is a surface with a shape that is gradually enlarged toward the circulation loop 42, and is capable of directing the gas entering the circulation loop 42 and increasing the flow. When the ring 22 moves until the second section 38 leaves the groove 52, the branch passage 26 opens between the main passage 24 and the circulation loop 42. It is contemplated that the design of the side surface 35 of the ring 22 is not limited to the above-described shape, and the side surface 35 may have other shapes. It is of course also possible to make other designs on the side surface of the ring, such as, but not limited to, embedding a seal at the second section to enhance the sealing effect. Similarly, the rear surface 36 of the ring may also be designed for the branch passage 26 or as a part of the branch passage 26. The figure shows that the branch passage 26 is formed on the side of the ring 22 that is radially close to the impeller 12, and may also be formed on the other side opposing to the side.

The circulation loop 42 is integrated inside the compressor. The circulation loop 42 is disposed in the first partition 16 and in adjacent to the drive mechanism 28. The inlet 43 of the circulation loop 42 is in communication with the groove 52. For example, the inlet 43 is disposed at the junction of a bottom wall 53 and an inner wall 54 of the groove 52. The inlet 43 of the circulation loop 42 may also be disposed only on the bottom wall of the groove 52, forming the branch passage with the rear surface 36 of the ring 22, or may be disposed only on the inner wall of the groove 52, forming the branch passage with the side surface 35 of the ring 22. The circulation loop 42 is realized by perforating the inside of the first partition 16 to form a flow passage, so that it is not necessary to provide an additional flow passage other than in the diffuser. The circulation loop 42 comprises at least one flow passage passing through the first partition 16. The circulation loop 42 comprises a first flow passage 45 and a second flow passage 46 that are connected to each other, wherein the second flow passage 46 will also continue to pass through a seal ring 15 between an impeller shroud 11 and the impeller 12. The first flow passage 45 and the second flow passage 46 guide the refrigerant gas through the first partition 16, and after the refrigerant gas leaves the second flow passage 46, it flows to the inlet of the impeller 12 via a radial passage between the impeller shroud 11 and the seal ring 15. The design of the flow passage of the circulation loop 42 is not limited to the above described form. For example, but not limited, the outlet of the circulation loop 42 can be connected to the intermediate of the impeller 12, or the outlet of the circulation loop 42 can be connected upstream of the impeller 12 so that the refrigerant gas in the circulation loop 42 enters the impeller again.

Figure 5:
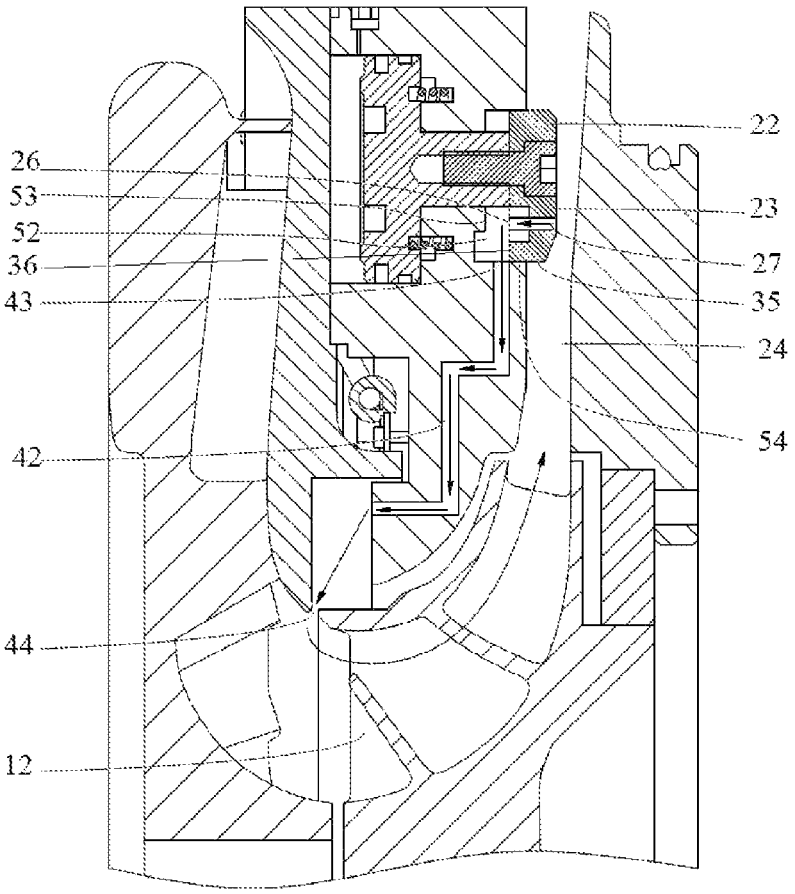
FIG. 5 is a partial sectional view showing another embodiment of a centrifugal compressor according to the present application, wherein arrows indicate a gas circulation path.

FIG. 5 is a partial sectional view of another embodiment of a centrifugal compressor according to the present application. The same portions as those of the embodiment of FIGS. 2-4 are not described herein again. The object to be compressed is still a refrigerant. In the illustrated embodiment, the ring 22 has a protruding portion 23 extending radially into the first partition 16. An additional flow passage 27 is disposed on the protruding portion 23 to form a portion of the branch passage 26. When the ring 22 moves into the main passage 24, a portion of the refrigerant gas in the main passage 24 first enters the additional flow passage 27, enters the groove 52, and then flows to the inlet of the impeller 12 through the circulation loop 42. When the ring 22 is back to the initial position, the rear surface 36 of the ring 22 abuts against the bottom wall 53 of the groove 52, whereby gas cannot flow from the additional flow passage 27 into the groove 52. When the gap between the side surface 35 of the ring 22 and the inner wall 54 of the groove 52 is so small that the refrigerant gas in the main passage cannot pass through the gap, the diverted refrigerant gas may be introduced into the circulation loop 42 by disposing the additional flow passage 27 in the ring 22. In the illustrated embodiment, the additional flow passage 27 is disposed on the protruding portion 23 of the ring 22. It is contemplated that the protruding portion may not be provided. By way of example and without limitation, the additional flow passage may be disposed directly on a portion of the body of the ring that is not connected to the drive mechanism, or disposed on the partition.

In the illustrated embodiment, the design of the circulation loop 42 is different from the circulation loop of FIGS. 2-4, wherein the inlet 43 of the circulation loop 42 is disposed on the inner wall 54 of the groove 52, the circulation loop 42 comprises more sections of flow passages, and the outlet 44 is still in communication with the inlet of the impeller 12. When the ring 22 moves into the main passage 24, a portion of the refrigerant gas in the main passage 24 is circulated back to the inlet of the impeller 12 in the flow direction indicated by the arrows in FIG. 5. It should be understood that the number of circulation loops 42 is not limited to one as illustrated, and more circulation loops may be provided on the partition, wherein relevant designs such as the size of the flow passage, the number of sections of the flow passages and the like depend on expected circulation parameters.

Figure 6:
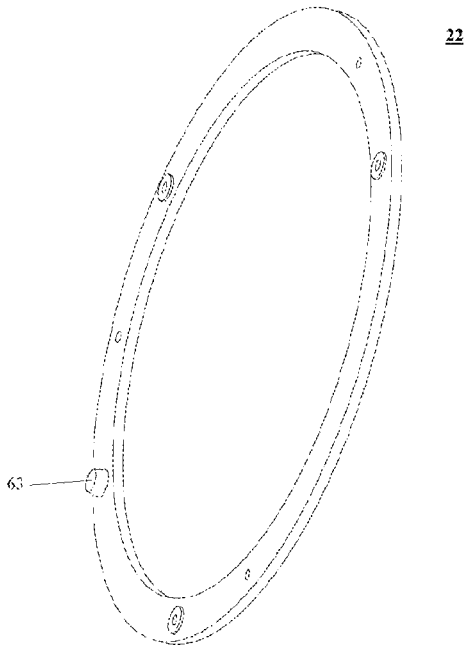
FIG. 6 is a schematic view of a ring of yet another embodiment of a centrifugal compressor according to the present application.
Figure 7:
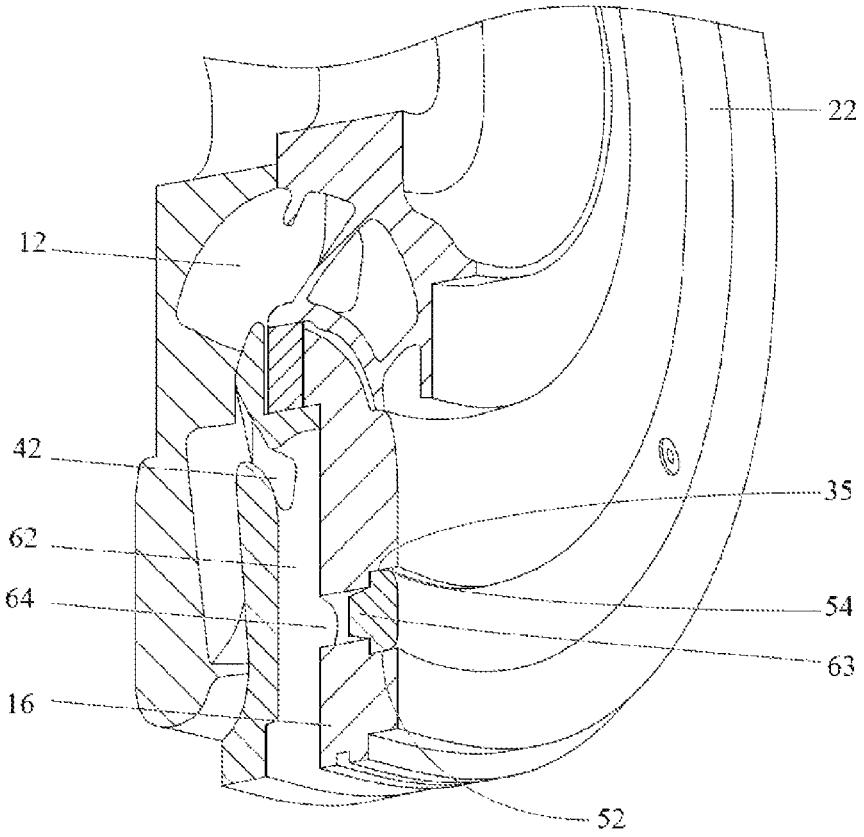
FIG. 7 is a schematic view of the ring of FIG. 6 after being mounted to the centrifugal compressor.
Figure 8:
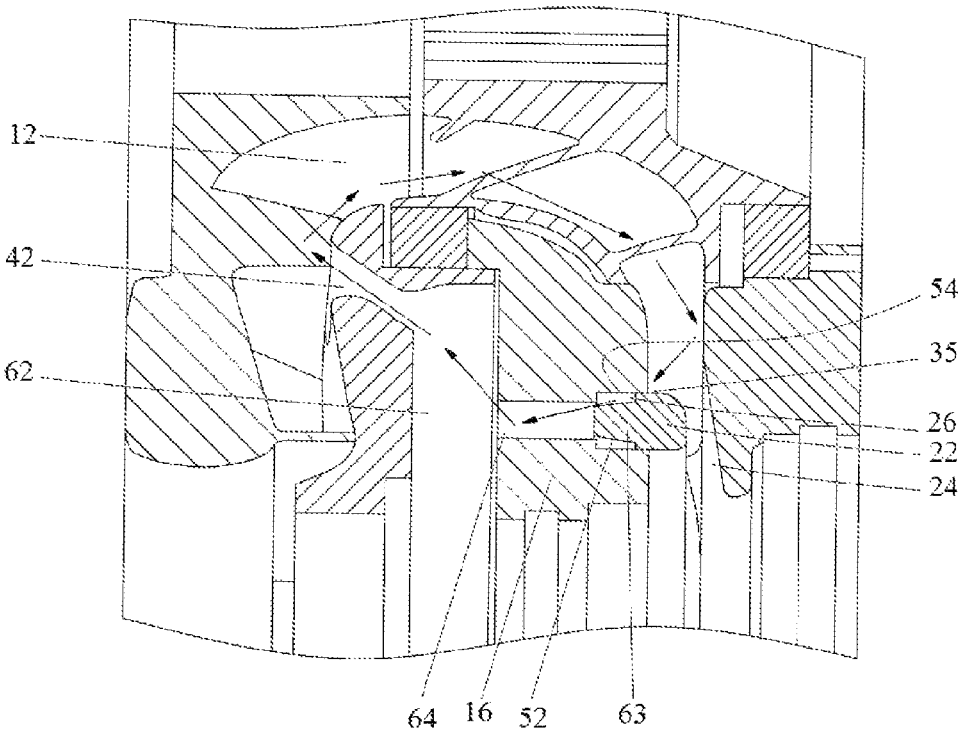
FIG. 8 is a schematic view of the ring of FIG. 7 when it moves into the main passage, wherein arrows indicate a gas circulation path.

FIGS. 6-8 show schematic views of yet another embodiment of a centrifugal compressor according to the present application. FIG. 6 is a schematic view of the ring 22 in the embodiment, FIG. 7 is a schematic perspective view of the centrifugal compressor of FIG. 6 with the ring 22 assembled, wherein the ring 22 is in the initial position, and FIG. 8 is a partial sectional view of the centrifugal compressor of FIG. 6, wherein the ring 22 moves into the main passage 24. The object to be compressed is still a refrigerant. Unlike the previous embodiments, the circulation loop 42 is not formed in the first partition, but is formed by means of another existing portion of the housing, such as a chamber in the compressor. By utilizing a chamber adjacent to the impeller, a portion of the refrigerant gas in the main passage returns to the impeller via the chamber to supplement the suction amount of the impeller.

In the illustrated embodiment, the chamber adjacent to the impeller 12 is an ejection chamber 62 of an economizer. When the branch passage 26 is open, a portion of the refrigerant gas from the main passage 24 enters the ejection chamber 62 of the economizer via the branch passage 26, and is mixed with the refrigerant from the ejection chamber 62 before returning to the inlet of the impeller 12.

The branch passage 26 is opened and closed through the movement of the ring 22. The ring 22 is provided with a protruding head 63 which is arranged in a staggered manner with respect to a drive mechanism not shown, and correspondingly, a bore 64 is provided in the first partition 16 at a position corresponding to the head 63 for communication with the ejection chamber 62 of the economizer. The head 63 is inserted into the bore 64, and the design of the head 63 will be described below. The ring 22 returns to the groove 52 in the first partition 16 within which the ring 22 fits. The side surface 35 of the ring 22 is in contact with the inner wall 54 of the groove 52 with no gap therebetween, and the branch passage is closed. The ring 22 moves into the main passage 24 under the action of a drive mechanism not shown, the ring 22 leaves the groove 52 to create a gap, and the branch passage 26 is formed in the groove 52, whereby a portion of the refrigerant gas in the main passage 24 may pass through the gap to enter the groove 52, then flows along the bore 64 to the ejection chamber 62 of the economizer, and is circulated back to the impeller 12 by means of the power from the ejection chamber 62, as shown in FIG. 8.

By elaborately making use of an existing portion of a housing inside the compressor, the design of the embodiment illustrated in FIGS. 6-8 enables at least a portion of the circulation loop 42 to be shared with the compressor and reduces additional component processing. Therefore, the complexity of the compressor system is not increased. It will be appreciated that the circulation loop 42 may make use of any chamber inside the compressor as long as the circulated gas is finally circulated back to the impeller.

The protruding head 63 is configured to have a shape that tapers toward the ejection chamber 62 (i.e., the circulation loop 42), that is, the protruding head 63 is configured to increase gradually toward the main passage 24 and shaped as a cone. During the movement of the ring 22 toward the main passage 24, the area of the gap between the ring 22 and the groove 52 is gradually enlarged due to the tapered shape, thereby gradually increasing the flow of the refrigerant gas. Therefore, the circulation effect may be controlled by designing the head 63, and in particular, it is desirable to implement the circulation of the refrigerant gas in a relatively gentle manner. Moreover, it is also possible to control circulation parameters such as the moment the circulation starts, a circulation duration, a flow rate and the like in combination with the side surface 35 of the ring 22. The head 63 may have other shapes than the above shape. In the embodiment shown in FIG. 6, the number of the heads 63 is one, and it is conceivable that there may be a plurality of heads. The number of holes 64 is the same as that of the heads 63. When the number of the heads 63 is determined, the same number of holes 64 are provided on the first partition 16

It is to be understood that the present disclosure is not limited to the embodiments described above, and that various modifications and improvements may be implemented without departing from the inventive concepts described herein. Any of the features can be applied separately or in combination with any other feature, and the present application extends to and includes all combinations and subcombinations of one or more of the features described herein, unless the features contradict with each other. By way of example and without limitation, the present application can be used in combination with a vane-type diffuser, i.e., a plurality of variable vanes disposed on the second partition while a ring according to the present application is disposed on the first partition, wherein the ring and the variable vanes are disposed in a radially staggered manner.

The ring referred to in this application may be used in a variety of working conditions. When it is desired to circulate a portion of the refrigerant gas in the main passage 24, the branch passage 26 can be opened by moving the ring 22 so that the diverted refrigerant gas is circulated. Alternatively, when the centrifugal compressor is operating near the surge boundary in the characteristic map of the compressor, the ring 22 can move into the main passage 24 so that a portion of the refrigerant gas is circulated to the impeller 12 to supplement the suction amount of the impeller 12. When the circulation is not required, the ring 22 returns to the initial position.

The present application can be applied to a variety of compressors, and the compressor may or may not include an economizer. The compressor can be a single-stage compressors or a multi-stage compressor. When the drive mechanism 28 moves the ring 22 into the main passage 24, the part of the refrigerant gas in the main passage 24 is circulated back to the impeller 12 to reduce compressor noise and vibration.

While the specific embodiments of the present application have been shown and described in detail to illustrate the principles of the application, it should be understood that the present application can be implemented in other ways without departing from the principles.

What is claimed is:

1. A centrifugal compressor, comprising:

an impeller (12) configured to suction a gas to be compressed;

a diffuser (13) disposed downstream of the impeller (12) to pressurize the gas, the diffuser (13) comprising a movable ring (22), a main passage (24) in which the gas flows past the ring (22), and an openable branch passage (26); and a circulation loop (42) comprising an inlet (43) and an outlet (44), the outlet (44) being in communication with an inlet of the impeller (12);

wherein the branch passage (26) is disposed to be in communication with the main passage (24) and the circulation loop (42) when the ring (22) moves into the main passage (24) so that a portion of the gas in the main passage (24) passes through the circulation loop (42) and returns to the impeller (12) so as to be suctioned, and to be closed when the ring (22) is withdrawn from the main passage (24);

wherein at least a portion of the circulation loop (42) is formed by a chamber inside the centrifugal compressor that is close to the impeller (12), and the outlet of the circulation loop (42) is an outlet of the chamber.

2. The centrifugal compressor according to claim 1, wherein the chamber is an ejection chamber (62) of an economizer.

3. The centrifugal compressor according to claim 1, wherein the ring (22) has at least one protruding head (63) configured to have a shape that increases gradually toward the main passage (24) such that the head (63) controls a flow of the gas flowing toward the circulation loop (42) when the branch passage (26) is open.

* * * * *